US006196071B1

(12) United States Patent
Shomo

(10) Patent No.: US 6,196,071 B1
(45) Date of Patent: Mar. 6, 2001

(54) TORQUE INDICATOR SOCKET

(76) Inventor: Robert D. Shomo, 1435 Duff La., Milford, MI (US) 48381

( * ) Notice: Subject to any disclaimer, the term of this patent is extended or adjusted under 35 U.S.C. 154(b) by 0 days.

(21) Appl. No.: 09/252,758

(22) Filed: Feb. 19, 1999

Related U.S. Application Data

(60) Provisional application No. 60/075,763, filed on Feb. 23, 1998.

(51) Int. Cl.[7] ..... B25B 23/14

(52) U.S. Cl. ..... 73/862.21; 73/862.23; 73/761; 173/176

(58) Field of Search ..... 73/862.21, 862.22, 73/862.23, 761; 33/355 R; 173/176

(56) References Cited

U.S. PATENT DOCUMENTS 4,091,664 * 5/1978 Zerver .
4,218,828 * 8/1980 Hoting et al. ..... 73/862.21
4,226,127 * 10/1980 Hardiman ..... 73/862.23
4,244,434 * 1/1981 Wilson ..... 73/862.23
4,257,263 * 3/1981 Herrgen ..... 73/862.23
4,265,109 * 5/1981 Hallbauer et al. ..... 73/862.23
4,283,830 * 8/1981 Gallizio et al. ..... 73/862.23
5,236,053 * 8/1993 Butsch ..... 173/176

* cited by examiner

*Primary Examiner*—Eric S. McCall
(74) *Attorney, Agent, or Firm*—Charles C. Valauskas

(57) ABSTRACT

A system by which the torque applied to a fastener such as a bolt or nut may be measured simply and accurately. More particularly, the invention relates to apparatus and methods by which the torque applied to a fastener by a socket wrench can be measured through a simplified extension element accurately and displayed quickly so that the placement of possibly damaging excessive amounts of pressure on the fastener can be avoided.

1 Claim, 1 Drawing Sheet

TORQUE INDICATOR SOCKET

This application is based on U.S. provisional application serial No. 60/075,763 filed on Feb. 23, 1998.

FIELD OF THE INVENTION

The subject invention relates to a system by which the torque applied to a fastener such as a bolt or nut may be measured simply and accurately. More particularly, the invention relates to apparatus and methods by which the torque applied to a fastener by a socket wrench can be measured accurately and displayed quickly so that the placement of possibly damaging excessive amounts of pressure on the fastener can be avoided.

BACKGROUND OF THE INVENTION

Standard torque wrenches are essentially cantilever beams having a socket attached at one end and a grip handle at a generally opposing end. That possibly damaging excessive amounts of pressure may be applied to the bolt or nut fastener—that is, "overtorquing" the fastener—is always a danger when using such tools.

Certain socket wrenches include a mechanical dial indicator that identifies the degree to which the beam is being bent when force is exerted on the handle in order to tighten the nut or bolt fastener. Other conventional torque wrench systems do not use an indicator but instead provide an audible signal when a certain level of force has been applied to the fastener. To prevent "overtorquing", an additional conventional torque wrench system includes a ratchet system in the handle that releases when a certain level of force has been applied to the fastener.

A number of disadvantages are associated with the conventional socket wrenches that include torque indicators. Typically, the beam of the conventional wrench system must be perfectly perpendicular to the long axis of the fastener in order that the torque applied to the fastener through the wrench can be measured accurately. Such a perpendicular alignment is difficult to attain quickly when working with most fasteners. Also, such a perpendicular alignment cannot be obtained when the wrench includes a "universal joint" type. of socket extension. Additionally, the conventional torque socket with indicator are cumbersome and difficult to place properly in tight places.

A demand therefore exists for a simplified system by which the torque placed on a fastener can be measured quickly and accurately. The present invention satisfies the demand.

The system of the present invention utilizes magneto—elastic technology to detect changes in an external magnetic field created by a circumferentially magnetized element attached to or integrated with a shaft and proportional to the torque applied to the shaft. The system includes an extension element and a converter/display unit that is in communication with the extension element such as through a signal cable.

More specifically, the extension element includes a base, a magnetized ring, a sensor, and a cover that not only extends over the surface of the magnetized ring but also by which the sensor is positioned adjacent to the ring. The base is sized and shaped and constructed such that the pressure applied to the socket wrench can be transferred to a standard socket and thereby the fastener. A circumferentially magnetized, magnetorestrictive ring is rigidly attached to an outer surface of and around a center portion of the base. A sensor that can measure the Hall effect or similar magnetic field intensity is positioned adjacent to but spaced from the magnetized ring by a cover that can surround the ring. The converter/display unit of the system can receive—such as through a cable—the information from the sensor regarding the torque that is being placed on the extension element and thereby the socket to which it is attached and convert and display the information in a readily usable form such as torque units.

One advantage of the present invention is that the system provides accurate measurements of the torque that is being placed on a fastener quickly and without excessive preparations in positioning the system relative to the fastener.

Another advantage of the present invention is that the system can accept and use standard sockets and socket wrenches thereby avoiding the need for replacement of all of the components of a conventional wrench system.

An additional advantage of the present invention is that the system is of a simplified construction that increases the reliability of the system while decreasing the cost of manufacturing the system.

It is, accordingly, a general object of the present invention to provide a system by which the torque placed on a socket through the use of a socket wrench can be measured quickly and without excessive adjustment and preparation of the system relative to the fastener.

Another object of the present invention is to provide a system that can utilize standard sockets and socket wrenches thereby providing a universal system for measuring torque.

An added object of the present invention is to provide a system that allows socket wrenches to be used such that pressure need not be placed uniformly on the wrench beam and/or the socket in order to obtain an accurate torque reading.

An additional object of the present invention is to provide a system that is of a simplified and thereby reliable construction that can be produced at a low cost.

These and other objects, features, and advantages of this invention will be. clearly understood and explained with reference to the accompanying drawings and through a consideration of the following detailed description of the preferred embodiments.

DETAILED DESCRIPTION OF THE INVENTION

A system for measuring and reliably identifying the torque placed on a fastener according to the present invention is identified in the accompanying drawings as 21. The system 21 includes an extension element 31 and a converter/display unit 81.

Figure 2:
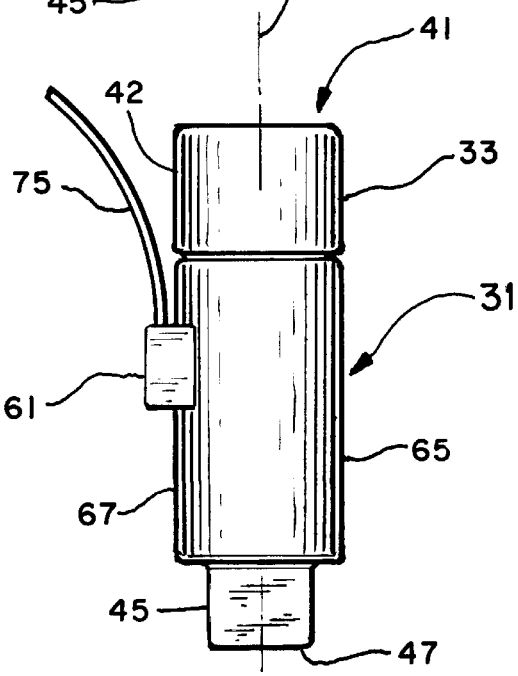
FIG. 2 illustrates a side view of the extension element.

The extension element 31 includes a base 33, a magnetized ring 51, a sensor 61, and a cover 65. For convenience of description, terms such as "outer", "inner", "horizontal", "vertical", and "outwardly" are used to refer to the extension element 31 in an orientation as illustrated in the accompanying FIGS. 2 and 3. However, it will be understood that during use, the element 31 advantageously can be used in a variety of orientations thereby increasing the utility of the system 21.

The base 33 is sized and shaped and constructed such that the pressure applied to a socket wrench 101 can be transferred to a standard socket (not shown). and thereby the fastener (not shown). The embodiment of the base 33 illustrated in the FIGS. is a shaft 35 that is generally aligned along an axis "A". The shaft 35 includes a wrench end 41 and an socket end 45. The wrench end 41 includes an aperture 43 sized and shaped such that the base 33 and thereby the extension element 31 can be attached to and detached from the socket wrench 101. The socket end 45 of the base 33 includes a tip 47 sized and shaped such that the tip 47 and thereby the extension element 31 and the wrench 101 can be attached to and detached from a standard socket (not shown). Preferably, the base 33 is made of a material that can transmit the pressure applied by the wrench 101 to the socket and fastener without irreversibly bending or breaking. Heat treated steel is one such preferred material.

Figure 3:
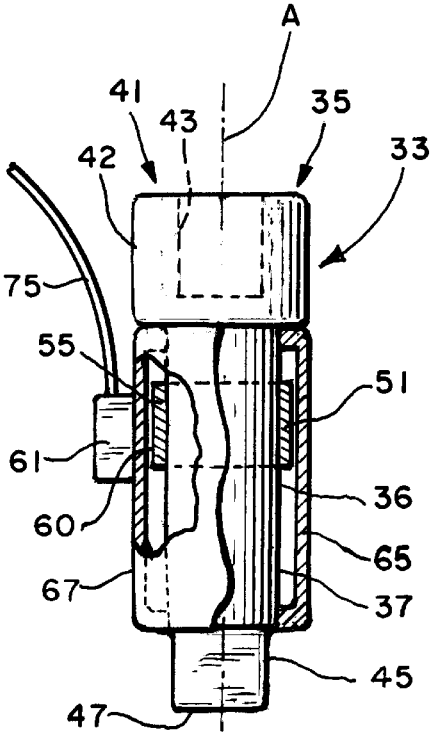
FIG. 3 illustrates a side partial cut away and partial cross sectional view of the extension element illustrated in FIG. 2.

A magnetized ring 51 is integrated with or attached to the outer surface 37 of the base 33. FIG. 3 illustrates an embodiment of the element 31 that includes a magnetized ring 51 securely attached—such as by press fitting—to the outer surface 37 of and around a center portion 36 of the base 33. The ring is composed of an alloy that retains magnetization.

A sensor 61 that can measure the Hall effect or similar magnetic field intensity produced by the placement of pressure on the extension element 31 and thereby the base 33 and the ring 51 is positioned adjacent to but spaced from the ring 51. FIG. 3 illustrates an embodiment of the element 31 in which the sensor is positioned adjacent to the ring 51 such that a gap 60 is formed between the surface 55 of the ring 51 by a cover 65. One type of suitable sensor 61 is known as a "Hall Effect" transducer. Other types of sensors that are suitable include electrical resistance strain gauges, piezoelectric strain gauges, ceramic strain gauges, and other forms of magneto—elastic torque measuring systems.

The sensor 61 shown in the illustrated embodiments is attached to the outer surface 67 of the cover 65. The cover 65 in these embodiments surrounds the base 33 such that the outer surface 67 is generally even with the outer surface 42 of the base 33 adjacent to the wrench end 41 to facilitate easy handling of the element 31 and insertion even in areas providing limited space to operate. The cover 65 may be made from a suitable resilient material such as types of metal or plastic.

Figure 1:
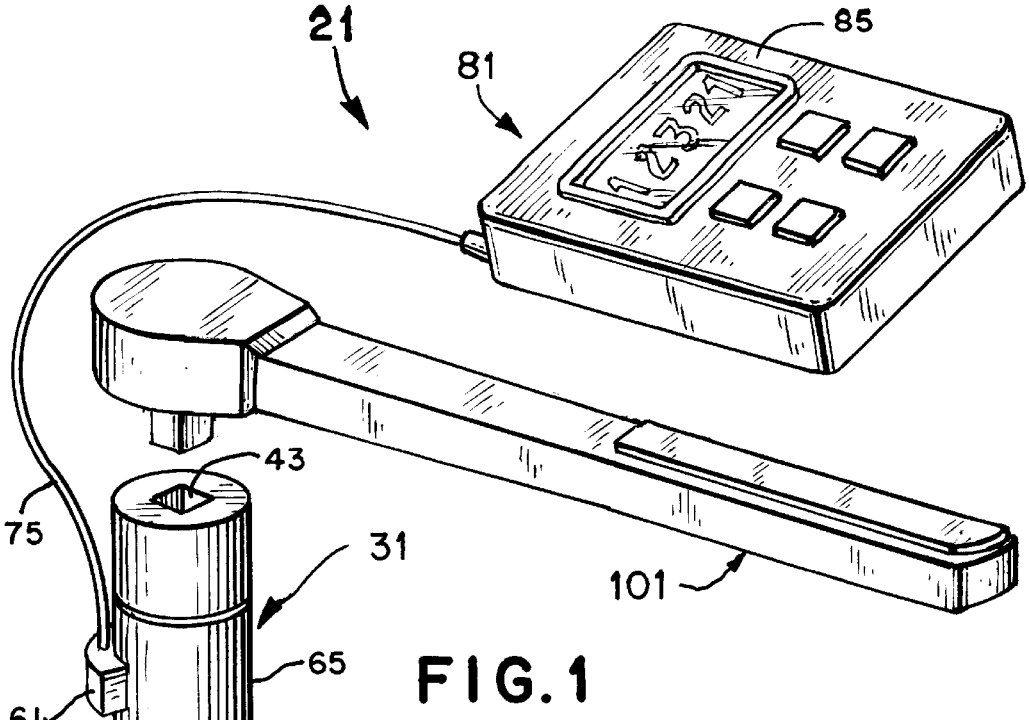
FIG. 1 illustrates a perspective view of an embodiment of the present invention showing the system including extension element and converter/display unit.

By placing pressure on the wrench 101 and thereby the base 33 during the adjustment of a fastener with a socket, the magnetic lines produced by the magnetic ring 51 are altered in a way that can be detected by the sensor 61. Information regarding such changes can be transmitted—such as by the signal cable 75 shown in the attached FIGS.—to the converter/display unit 81. The converter/display unit 81 converts the change in magnetic lines of force detected by the sensor 61 to voltages which in turn may be converted, for example, to numerals representing inch-lbs of torque or other appropriate information. The converter/display unit 81 shown in the attached FIG. 1 may be of the type having a display 85 in English or metric units using a liquid crystal display readout.

It will be understood that the embodiments of the present invention which have been described are illustrative of some of the applications of the principles of the present invention. Numerous modifications may be made by those skilled in the art without departing from the true spirit and scope of the invention.

I claim:

1. A system for detecting and displaying torque pressure placed on a fastener from a socket wrench through a socket, said detection/display system comprising:

an extension element including a base having a wrench end sized and shaped such that the socket wrench can be attached thereto and a socket end sized and shaped such that the socket can be attached thereto;

said base including a base outer surface to which is attached a ring that produces a magnetic field;

a sensor by which changes in the magnetic field produced by placement of the pressure on the extension element are detectable, said sensor positioned adjacent to but spaced apart from said ring by a cover;

said sensor in communication with a converter/display unit by which the changes detected in the magnetic field are converted and displayed such that the placement of excessive pressure on the fastener may be avoided.

* * * * *